US005553843A

United States Patent [19]

Schenk

[11] Patent Number: 5,553,843

[45] Date of Patent: Sep. 10, 1996

[54] ADAPTER SYSTEM TO INTEGRATE REPRODUCTION APPARATUS TO SHEET OUTPUT PROCESSING APPARATUS WITH LATERAL REGISTRATION

[75] Inventor: Richard C. Schenk, Webster, N.Y.

[73] Assignee: Xerox Corporation, Stamford, Conn.

[21] Appl. No.: 354,580

[22] Filed: Dec. 13, 1994

[51] Int. Cl.[6] ..... B65H 9/00; B65H 31/20

[52] U.S. Cl. ..... 271/226; 271/253; 271/223

[58] Field of Search ..... 414/396, 401, 414/584, 609, 662; 271/162, 213, 214, 223, 226, 241, 253, 264, 278

[56] References Cited

U.S. PATENT DOCUMENTS

| | | | |
|---|---|---|---|
| 5,144,369 | 9/1992 | Benedict et al. | 414/401 X |
| 5,326,093 | 7/1994 | Sollitt | 271/306 |
| 5,342,034 | 8/1994 | Mandel et al. | 270/53 |
| 5,478,185 | 12/1995 | Kranz | 414/609 X |

*Primary Examiner*—F. J. Bartuska

[57] ABSTRACT

In a reproduction system in which a reproduction apparatus with an output of printed sheets at a sheet output position (usually edge registered) is operatively connected to an output sheet processing apparatus having a sheet input position (usually center registered) for sequentially receiving and processing the printed sheets, a lateral alignment system is provided for laterally aligning the sheet input position of the output sheet processing apparatus directly with the sheet output position of the reproduction apparatus without an intermediate sheet transport. The lateral alignment is preferably with a universal interconnect and transporter module or unit adapted to support and transport various different sheet processing apparatus. The lateral realignment may be manually or automatically varied in accordance with the selected size of the printed sheets by corresponding movement of a lateral repositioning system to laterally reposition the output sheet processing apparatus relative to the reproduction apparatus. The lateral repositioning system may include a slide rail mounting. The same module may further include a vertical alignment system and/or docking system. The sheet output position of the reproduction apparatus is repositionable directly adjacent to and linerally aligned with the sheet input position of the output sheet processing apparatus irrespective of changes in the size of the printed sheets.

2 Claims, 6 Drawing Sheets

Figure 10:
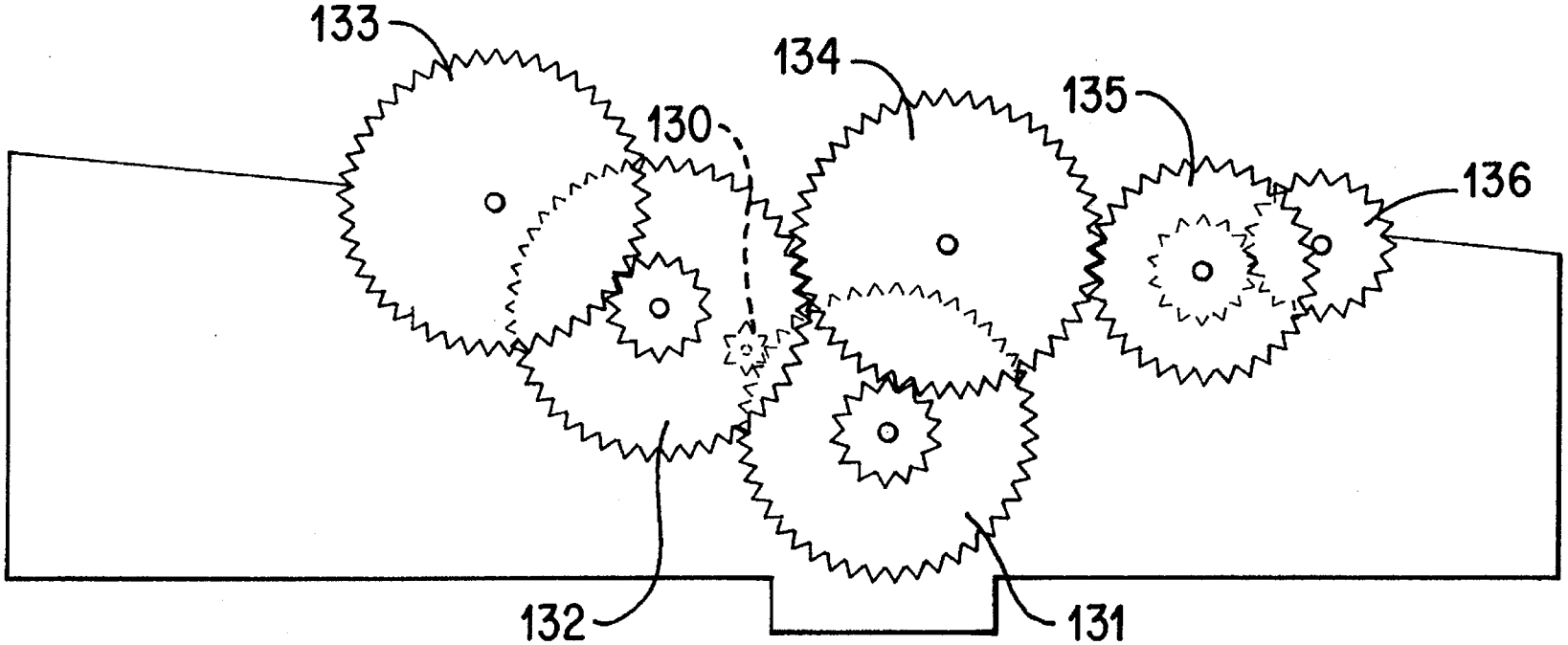

ADAPTER SYSTEM TO INTEGRATE REPRODUCTION APPARATUS TO SHEET OUTPUT PROCESSING APPARATUS WITH LATERAL REGISTRATION

The disclosed system provides for the improved mating of the sheet output of a reproduction apparatus to a sheet output processing apparatus (for the further processing of the output sheets), such as finishers, folders, booklet makers, book binders, inserters, and/or mailers, etc., particularly those from different manufacturers. More specifically, there is disclosed a compact, simple, and low force (low effort) operator adjustment system for the integration of edge registered apparatus to center registered apparatus, since various equipment is designed for different ones of these two systems.

Numerous examples of various such output sheet processing apparatus and patents thereon are described in U.S. Pat. No. 5,326,093, infra, and thus need not be repeated herein. Further examples are provided in Xerox Corporation U.S. Pat. No. 5,342,034 issued Aug. 30, 1994 to Barry P. Mandel, et al.

There are serious problems in compatably operatively connecting the output of various copiers and printers with various sheet output processors. Some of these problems are discussed in Xerox Corporation U.S. Pat. No. 5,326,093 issued Jul. 5, 1994 to Thomas E. Sollitt. Disclosed therein is a universal vertically adjustable interface module for interconnecting reproduction apparatus of varying output level heights with output processors of various input levels. However, the system therein requires a separate, interposed, modular interconnect unit, and does not specifically address other problems addressed herein of lateral registration, especially the mating of edge registered copiers or printers to center registered equipment for varying sizes of sheets. Col. 14, lines 28–34 of said U.S. Pat. No. 5,326,093 simply notes that if sheet path side registration is desired in the interface module path, that it can also be provided (and citing patents therefor).

Further by way of background, center registered paper paths and side registered paths have respective advantages and disadvantages, and thus both are used in copiers or printers and in finisher output devices from different manufacturers, or even within different models from the same manufacturer. As one example, a front edge registered copier is often used. In that case the one edge of the original document bring placed on the platen of the copier may desirably be registered to the front edge of the machine, closest to the operator. Likewise, a front edge registered copier places the copy sheets toward the front edge of the machine in the internal paper path of the machine for ease in jam clearance. However, side registration complicates the internal feeding of the copy sheets, since it means that different sizes of sheets will have non-centered feed rollers, which can induce skew. Also, an edge registered paper path may cause the edges of the sheets to rub against edge side guides in the paper path, which is also disadvantageous. There are various other factors involved in the decision between edge registration and side registration systems.

Many reproduction products are edge registered machines, whereas many third party output devices, particularly signature folder/binders or other finishers, are center registered devices. Heretofore, such third party output devices have typically had to be extensively modified, or provided with special interface transports or modules providing side shifting of the sheets between these respective units. However, such interface transports or modules increase cost, increase the overall footprint area or floor space required, and produce additional potential sheet jam sites, etc.. Furthermore, even if such an interface module has a side registration system, as suggested in said U.S. Pat. No. 5,326,093, Col. 14, middle, that would only provide registration of one side of a sheet to one particular fixed position and would not provide for changing a side registered sheet to center registration, much less the change in center registration required when the sheet size changes.

In contrast, the present system does not require any separate, interposed, interconnection module or transport. The disclosed embodiment allows the direct sheet path connection of the reproduction apparatus sheet output to the sheet input of a finishing device, yet provides for variable lateral realignment of one apparatus relative to the other so that print sheets which are edge registered in the reproduction apparatus may be fed in proper lateral alignment directly and linerally into the center line of a center registered output or finishing device, or vice versa, irrespective of changes in the size of the sheets.

By way of further explanation, a smaller copy sheet which is side registered requires more lateral shifting than a larger sheet when the sheet is being transferred between an edge registered system and a center registered system. That is, the amount of lateral or side shifting required for the sheet inherently varies with the size of the sheet, i.e., the sheet dimension transverse the sheet feeding direction. Typically, that is the long dimension of the sheet, since copiers or printers are more efficient being fed long edge first rather than short edge first, since that increases the number of sheets which can be fed at a given processor speed, i.e., printed with the shortest dimension of the sheet in the process or sheet movement direction.

A specific feature of the specific embodiment disclosed herein is to provide a reproduction system in which a reproduction apparatus with an output of printed sheets at a sheet output position is operatively connected to an output sheet processing apparatus having a sheet input position for sequentially receiving and processing the printed sheets from the reproduction apparatus; the improvement comprising a lateral alignment system for laterally aligning said sheet input position of said output sheet processing apparatus directly with said sheet output position of said reproduction apparatus without an intermediate sheet transport, comprising a mounting system for mounting said output sheet processing apparatus or said reproduction apparatus on said lateral alignment system for lateral movement thereon, and a lateral repositioning system for laterally repositioning said mounting system so as to laterally reposition said output sheet processing apparatus relative to said reproduction apparatus.

Further specific features provided by the system disclosed herein, individually or in combination, include those wherein said lateral alignment system comprises a universal interconnect module adapted to support thereon and transport various different said output sheet processing apparatus and to assist in said operative connection of various different said output sheet processing apparatus to various said reproduction apparatus, wherein said universal interconnect module contains said mounting system and said lateral repositioning system; and/or wherein said reproduction apparatus is an edge registered system, and said sheet output position thereof is edge registered, said output sheet processing apparatus is a center-registered system and said sheet input position thereof must be center registered, and wherein said lateral alignment system laterally aligns said sheet input position of said output sheet processing apparatus for said center registration with said edge registered sheet output position of said edge registered reproduction apparatus; and/or wherein said lateral realignment of said sheet input position of said output sheet processing apparatus relative to said sheet output position of said reproduction apparatus is varied in accordance with the selected size of said printed sheets being outputted by said reproduction apparatus by corresponding movement of said lateral repositioning system to laterally reposition said output sheet processing apparatus relative to said reproduction apparatus; and/or wherein said lateral realignment of said sheet input position of said output sheet processing apparatus relative to said sheet output position of said reproduction apparatus is automatically varied in accordance with the selected size of said printed sheets being outputted by said reproduction apparatus by a corresponding automatic movement of said lateral repositioning system; and/or wherein said lateral repositioning system comprises a slide rail mounting of said mounting system; and/or wherein said lateral repositioning system comprises a slide rail mounting of said mounting system and an operator adjustable positioning of said slide rail system; and/or further including a vertical alignment system comprising an operator controllable vertical elevator system for adjusting the vertical position of said mounting system for adjustably mounting said output sheet processing apparatus at different vertical levels for the variable vertical alignment of said sheet input position thereof with said sheet output position of said reproduction apparatus; and/or wherein said lateral alignment system comprises a modular unit with a docking system for docking said output sheet processing apparatus to said reproduction apparatus; and/or wherein said lateral alignment system comprises a universal transporter unit for transporting various different said output sheet processing apparatus thereon, on said mounting system, into and out of said operative engagement with various said reproduction apparatus; and/or wherein said sheet output position of said reproduction apparatus is repositionable directly adjacent to and linerally aligned with said sheet input position of said output sheet processing apparatus irrespective of changes in the size of said printed sheets.

The disclosed apparatus may be readily operated and controlled in a conventional manner with conventional control systems. It is well known in general and preferable to program and execute such control functions and logic with conventional software instructions for conventional microprocessors. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems.

In the description herein the term "sheet" refers to a usually flimsy sheet of paper, plastic, or other such conventional individual image substrate.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Figure 2:
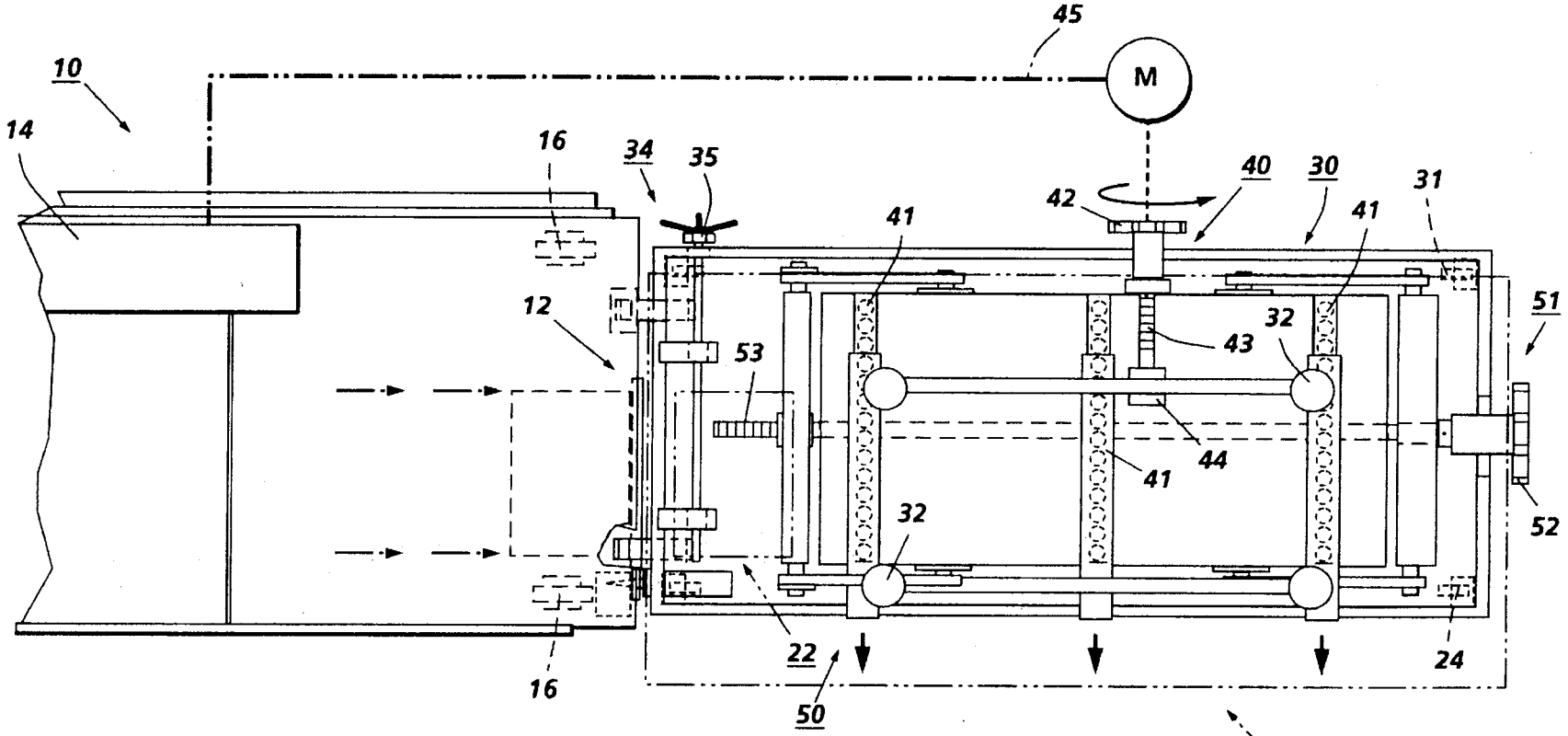
Figure 3:
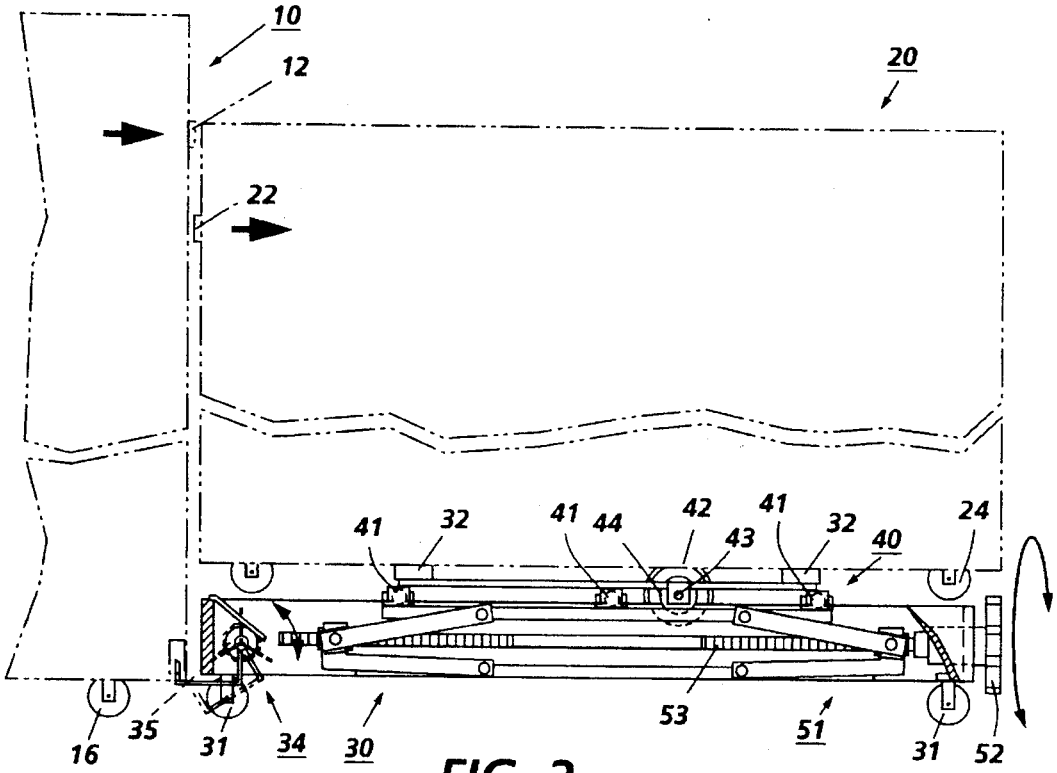
Figure 4:
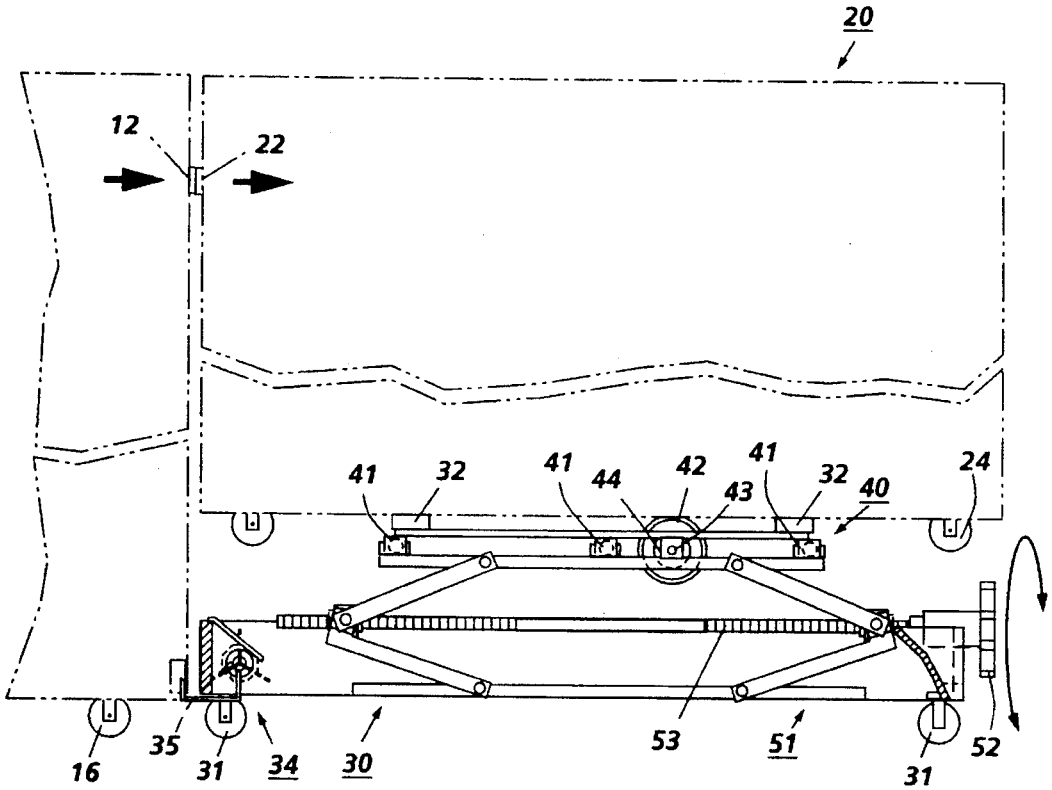
Figure 5:
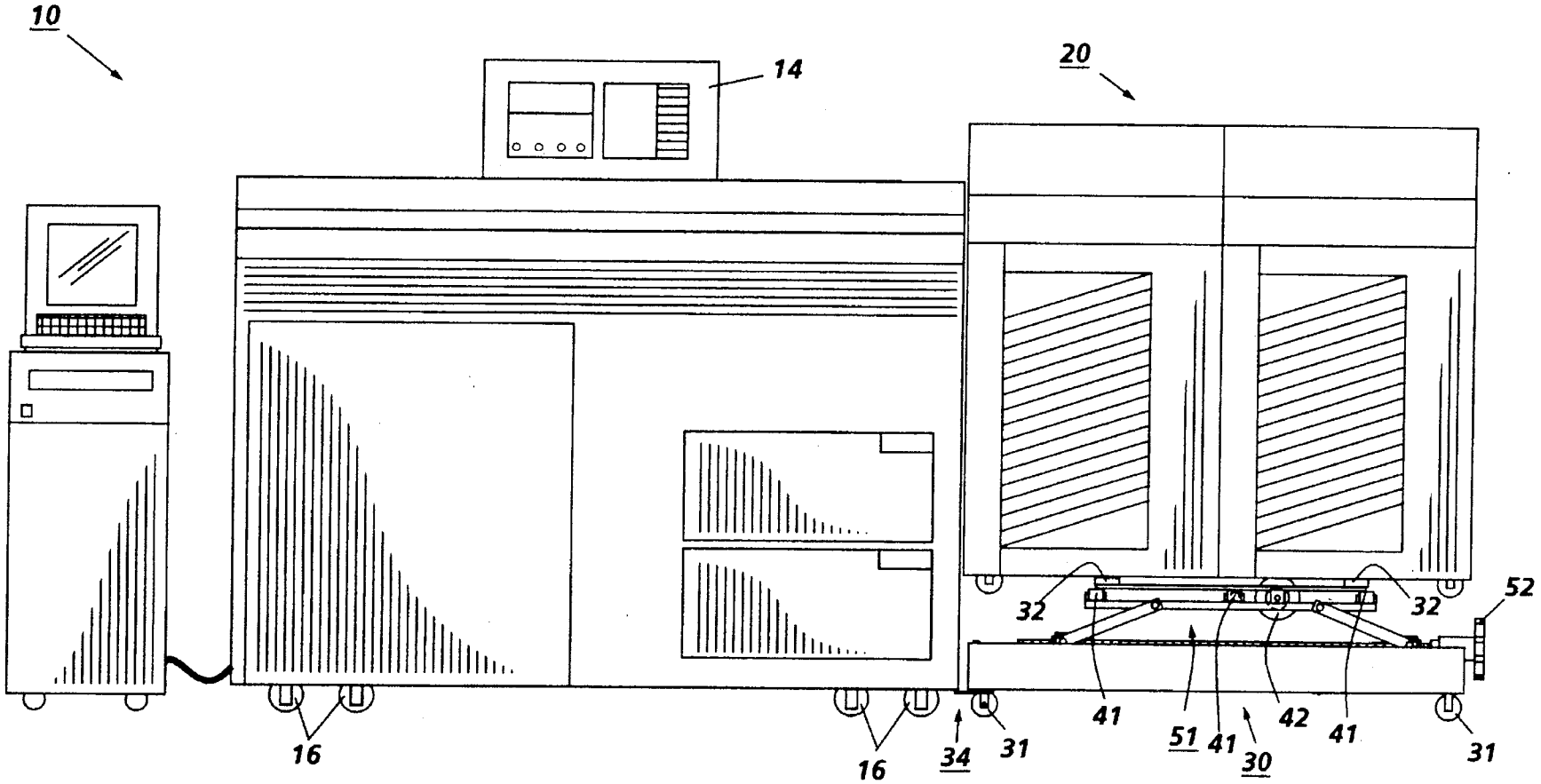
Figure 6:
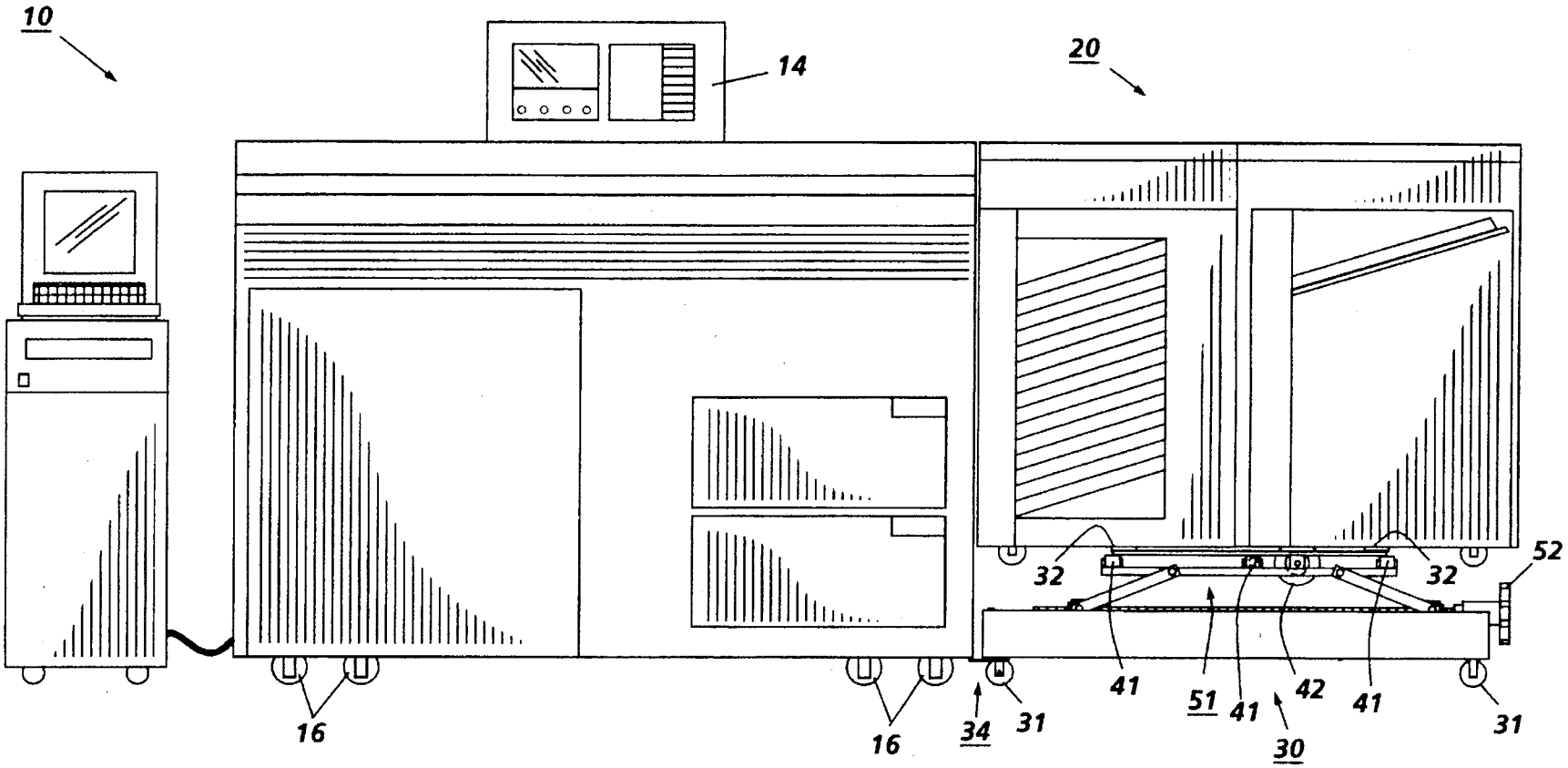
Figure 7:
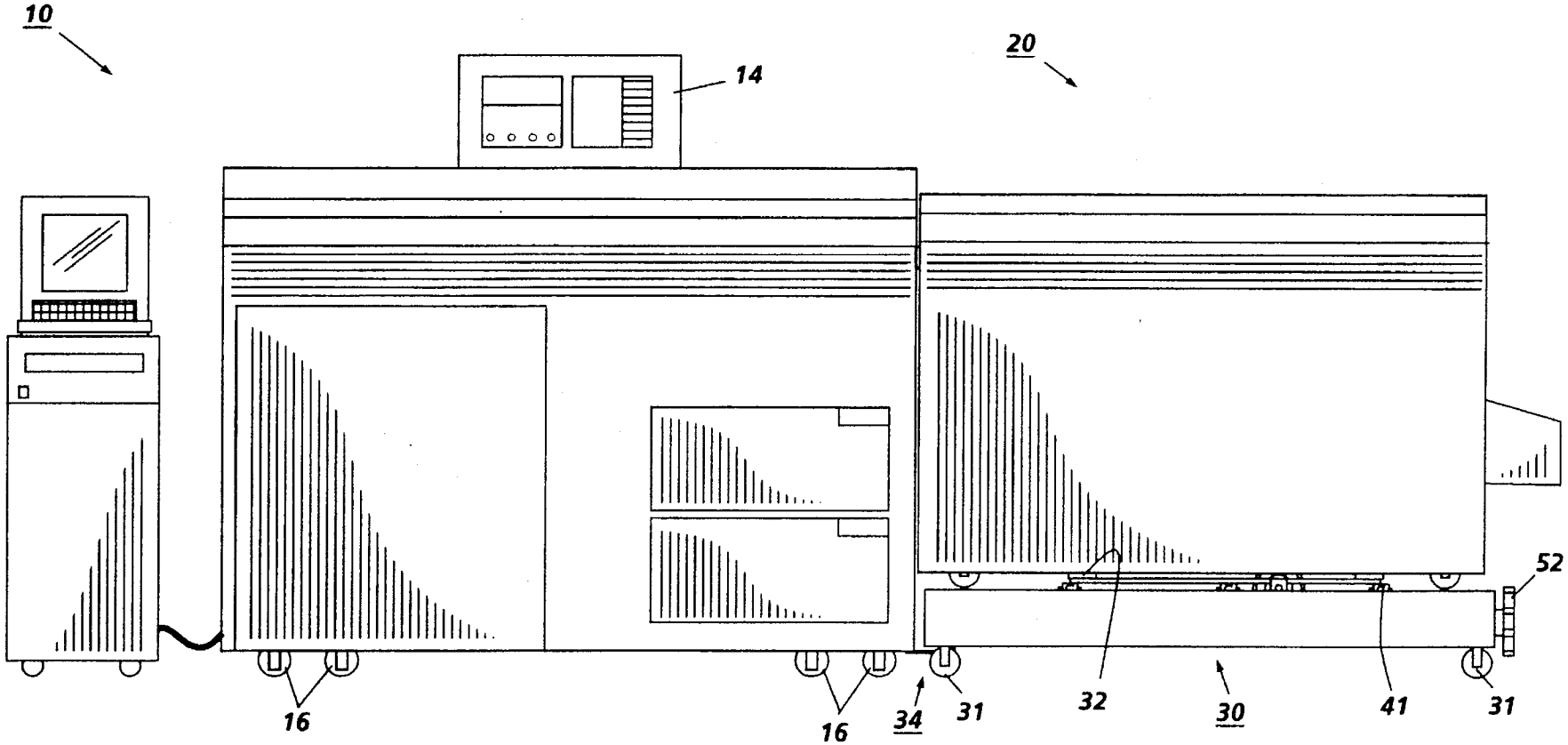
Figure 1:
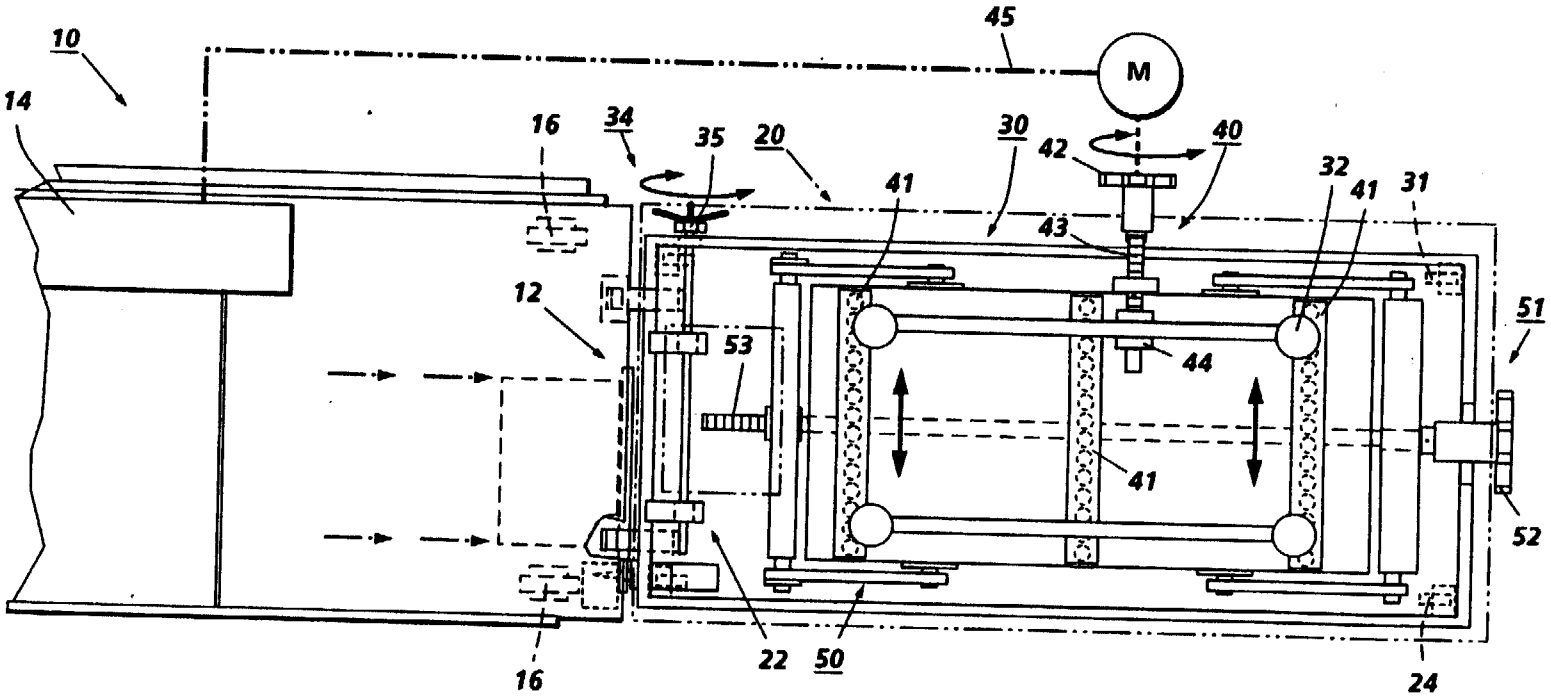

Various of the above-mentioned and further features and advantages will be apparent from the specific apparatus and its operation described in the example below, as well as the claims. Thus, the present invention will be better understood from this description of this embodiment thereof, including the drawing figures (approximately to scale) wherein:

FIG. 1 is a schematic top view of an exemplary reproduction apparatus operatively mated to an exemplary output apparatus such as a finisher (in phantom outline) in a laterally alignable manner utilizing an exemplary alignment module supporting the output apparatus which provides for lateral adjustment towards alignment of the sheet input of the output apparatus to the sheet output of the reproduction apparatus;

FIG. 2 is the same as FIG. 1, showing said lateral alignment (repositioning);

FIGS. 3 and 4 illustrate otherwise identical to one another side views of the embodiment of FIGS. 1 and 2 in respective lowered and raised positions of the alignment module; and FIGS. 5, 6 and 7 are side views in more detail of the exemplary reproduction apparatus and, respectively, three different output apparatus on the alignment module of FIGS. 1–4, showing three respective alignments provided by the same alignment module.

Turning now to the above-noted figures, there is illustrated an exemplary reproduction apparatus 10 which may be a copier or printer of any known or future type. The reproduction apparatus 10 is thus only illustrated with reference to its components relevant to this description, specifically a sheet output 12 and a controller and user interface (UI) panel 14 providing the usual conventional operator and/or automatic machine selection of the copy or print sheet size. Also shown under the reproduction apparatus 10 are conventional mounting wheels 16, although they are not required. The copy sheet output 12 of the reproduction apparatus 10 provides sequentially outputted printed sheets at a given fixed elevation and lateral position, as is conventionally provided. The lateral position of the output sheets will depend on whether the reproduction apparatus 10 is an edge registered or center registered machine. Typically, as described above, the reproduction apparatus 10 will be a front edge registered machine, and thus inherently not easily compatible with a center registered output sheet processing apparatus.

Shown here schematically is an exemplary output sheet processing apparatus 20, which, as described above, can be any of numerous finishers, folders, and other postprinting treatment devices for the output of the reproduction apparatus 10. Here, this output apparatus 20 has a center registered or centerline sheet input 22, into which it is desired to directly feed the side registered output sheets from the reproduction apparatus 10 by appropriate closely adjacent alignment therewith. The output apparatus 20 here is also shown with mounting wheels 24, although this is not necessary, and in fact the output apparatus 20 may be fully supported and/or palletized by the universal alignment module and transporter unit 30 to be described.

The exemplary alignment module 30 here can provide a transporter unit for the output apparatus 20, which is mounted thereon. Thus, here the alignment module 30 has mounting wheels 31 which can be used to move the module 30 while it holds the output apparatus 20, or by itself. However, the unit 30 may also or alternatively contain simple forklift or pallet loading slots thereunder, or therein (see below).

The exemplary alignment module and transporter unit 30 here has plural mounting pads 32 for mounting, on a substantially horizontal plane, any of various types of output apparatus 20. The pads 32 may in the alternative be replaced by or support a mounting plate.

Although the output apparatus 20 may itself include docking or locking apparatus to fasten itself to the reproduction apparatus 10, here in this example the alignment module 30 is also provided with its own docking latch system 34 including a docking latch lock 35. This optional docking latch system 34 is illustrated locking the module 30 to the output side of the reproduction apparatus 10 with locking hooks thereunder which then can be locked by the lock 35 until it is desired to undock the module 30 from the reproduction apparatus 10 for any reason (in which case the module 30 and any unit 20 thereon may be wheeled away on the optional mounting wheels 31). A standard DFA docking feature may be provided.

Referring now particularly to the lateral registration alignment system 40, it aligns output sheets at output position 12 from the reproduction apparatus 10 with the proper sheet path of the sheet input 22 of the output apparatus 20. This is provided here by providing such a lateral alignment system 40 in the universal alignment module unit 30. In the example here, as especially shown by comparing FIG. 2 with FIG. 1, this lateral registration system 40 comprises plural lateral slide rails 41 with ball bearings which allows the shifting of the mounting pads 32 or other mounting structure for the output apparatus 20 relative to the rest of the docked alignment module 30 and therefore relative to the reproduction apparatus 10. The lateral registration adjustment (and its latching) is shown in this example to be by a rotatable wheel 42 which may be easily rotated by the operator, with low force. The rotation of the wheel 42 rotates a screw shaft 43 here, which, through a connector 44, laterally and horizontally shifts the output apparatus 20 relative to the reproduction apparatus 10 by moving the output apparatus 20 mounting support 32 laterally on the slide rails 41.

This lateral alignment may be fully automated to be completely automatic, as by the optional phantom line illustrated electronic connection 45 in FIGS. 1 and 2 of the reproduction apparatus 10 controller 14 sheet size selection to a motor "M" connecting to the screw shaft 43. In this manner, the lateral alignment of the output apparatus 20 can be automatically made in direct response to paper size changes selected in the reproduction apparatus 10. The externally manually operator rotatable wheel 42, however, allows the initial alignment of the two units to be made manually when the output apparatus 20 is first docked with the reproduction apparatus 10, i.e., when the initial set up of the overall system is made, or at any time thereafter. Subsequent manual and/or automatic adjustment can be provided for different size sheets simply by rotation of the wheel 42, or other control.

In the event that a different lateral registration system is utilized which does not have a screw shaft 43 or other self-locking arrangement, it will be appreciated that, for example, mechanical detents can be provided for standard sheet sizes for the lateral position of the slide rails 41. If detents are not provided for different lateral rail positions for different standard sheet sizes, then visual positional marking indicators can be provided for lateral positions for shifting between, e.g., letter size and legal size copy sheets coming from a side registered reproduction apparatus into a center registered output apparatus.

The slide rails 41 may also provide the requisite spacing therebetween for forklift pallet loading of the module 30, with or without an output apparatus 20 mounted on top thereof.

Turning now to another optional but desirable feature also provided in the universal alignment module and transporter unit 30, this is a vertical alignment system 50. In the example shown here, this comprises an elevating jack system 51 with an operator rotatable wheel 52 rotating a screw shaft 53 which raises or lowers the elevating jack system 51. This in turn raises or lowers the slide rails 41, which in turn raises or lowers the mounting pads 32, and thus raises or lowers the output apparatus 20, so that the sheet input 22 thereof may be vertically aligned with the output of the reproduction apparatus 10. This allows a wide variety of different reproduction apparatus and a wide variety of different output apparatus to be interconnected for feeding sheets from one to the other properly, al illustrated in FIGS. 5–7. That is, the universal alignment module 30 easily allows the simple manual or automatic adjustment of the sheet input 22 position of any output apparatus to the vertical (co-horizontal) position of the sheet output 12 of any particular reproduction apparatus 10.

It may be seen that the disclosed system can accommodate a wide variety of third party suppliers' output devices, without requiring their equipment to be modified, and with optimization of operating parameters such as reduced likelihood of off-center sheet drive, sheet drag forces and skew. Instead of requiring a large number of special parts or special apparatus for interconnects, the same alignment module 30 may be utilized for any or all output apparatus and may be switched therebetween simply by the above-described adjustments to accommodate the varying sheet input positions and sheet lateral requirements of the particular output apparatus.

While the transporter system unit 30 will normally be used for mounting and registering an output apparatus, in some cases the finishing equipment may be larger than the reproduction apparatus. Thus, the unit 30 could alternatively be used to move and align the reproduction apparatus relative to a fixed location finishing device.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a reproduction system in which a reproduction apparatus with an output of printed sheets at a sheet output position is operatively connected to an output sheet processing apparatus having a sheet input position for sequentially receiving and processing the printed sheets from the reproduction apparatus; the improvement comprising:

a lateral alignment system for laterally aligning said sheet input position of said output sheet processing apparatus directly with said sheet output position of said reproduction apparatus without an intermediate sheet transport;

said lateral alignment system comprising a mounting system for mounting said output sheet processing apparatus or said reproduction apparatus on said lateral alignment system for lateral movement thereon, and a lateral repositioning system for laterally repositioning said mounting system so as to laterally reposition said output sheet processing apparatus relative to said reproduction apparatus;

wherein said lateral repositioning system comprises a slide rail mounting of said mounting system.

2. In a reproduction system in which a reproduction apparatus with an output of printed sheets at a sheet output position is operatively connected to an output sheet processing apparatus having a sheet input position for sequentially receiving and processing the printed sheets from the reproduction apparatus; the improvement comprising:

a lateral alignment system for laterally aligning said sheet input position of said output sheet processing apparatus directly with said sheet output position of said reproduction apparatus without an intermediate sheet transport;

said lateral alignment system comprising a mounting system for mounting said output sheet processing apparatus or said reproduction apparatus on said lateral alignment system for lateral movement thereon, and a lateral repositioning system for laterally repositioning said mounting system so as to laterally reposition said output sheet processing apparatus relative to said reproduction apparatus;

wherein said lateral repositioning system comprises a slide rail mounting of said mounting system and an operator adjustable positioning of said slide rail system.

* * * * *

UNITED STATES PATENT AND TRADEMARK OFFICE

CERTIFICATE OF CORRECTION

PATENT NO. : 5,553,843
DATED : September 10, 1996
INVENTOR(S) : Richard C. Schenk It is certified that error appears in the above-indentified patent and that said Letters Patent is hereby corrected as shown below:

IN THE DRAWINGS

Delete Drawing Sheet 1, and substitute therefor the Drawing Sheet, consisting of FIG. 1, as shown on the attached page.

Signed and Sealed this

Eleventh Day of February, 1997

*Attest:*

Bruce Lehman

BRUCE LEHMAN

*Attesting Officer*

*Commissioner of Patents and Trademarks*